US006742726B2

(12) United States Patent
Reiter

(10) Patent No.: US 6,742,726 B2
(45) Date of Patent: Jun. 1, 2004

(54) FUEL INJECTION VALVE

(75) Inventor: Ferdinand Reiter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/258,431

(22) PCT Filed: Feb. 25, 2002

(86) PCT No.: PCT/DE02/00662

§ 371 (c)(1),
(2), (4) Date: Mar. 25, 2003

(87) PCT Pub. No.: WO02/068811

PCT Pub. Date: Sep. 6, 2002

(65) Prior Publication Data

US 2003/0155440 A1 Aug. 21, 2003

(30) Foreign Application Priority Data

Feb. 24, 2001 (DE) ..... 101 08 974

(51) Int. Cl.[7] ..... F02M 59/00; F02M 61/00; F02M 63/00; F02M 51/00; B05B 1/30

(52) U.S. Cl. ..... 239/533.2; 239/585.1; 239/585.5; 251/129.18

(58) Field of Search ..... 239/533.2, 585.1, 239/585.5, 585.3, 585.4, 533.3, 533.6, 533.9, 88, 89, 91; 251/129.18, 129.15, 129.21, 285

(56) References Cited

U.S. PATENT DOCUMENTS 4,342,427 A * 8/1982 Gray ..... 239/585.2
5,029,807 A * 7/1991 Fuchs ..... 251/65
6,131,829 A * 10/2000 Ricco ..... 239/585.1
6,161,813 A 12/2000 Baumgartner et al.
6,367,769 B1 * 4/2002 Reiter ..... 251/129.19
6,435,429 B1 * 8/2002 Eichendorf et al. ..... 239/585.1
6,450,424 B1 * 9/2002 Horbelt ..... 239/585.1

FOREIGN PATENT DOCUMENTS

| | | |
|---|---|---|
| DE | 198 16 315 | 10/1999 |
| DE | 198 49 210 | 4/2000 |
| DE | 199 27 900 | 12/2000 |
| FR | 1 541 458 | 10/1968 |

* cited by examiner

*Primary Examiner*—Michael Mar
*Assistant Examiner*—Darren Gorman
(74) *Attorney, Agent, or Firm*—Kenyon & Kenyon

(57) ABSTRACT

A fuel injector, in particular for direct injection of fuel into the combustion chamber of a mixture-compressing, spark-ignited internal combustion engine, comprises an armature that coacts with a magnet coil, and comprises a valve needle, joined to the armature, on which is provided a valve-closure member that, together with a valve seat surface, forms a sealing seat. The valve needle has, downstream from the armature, a clamping sleeve whose axial position on the valve needle determines the height of a pre-stroke gap configured between the armature and an engaging flange that is joined nonpositively to the valve needle, the clamping sleeve being of tubular configuration and having a slit extending in the axial direction.

9 Claims, 2 Drawing Sheets

FUEL INJECTION VALVE

FIELD OF THE INVENTION

The present invention relates to a fuel injector.

BACKGROUND INFORMATION

German Published Patent Application No. 198 49 210 has already disclosed a fuel injector for fuel injection systems of internal combustion engines which has a magnet coil, an armature that can be impinged upon by the magnet coil against a return spring in a linear stroke direction, and a valve needle that is joined to a valve-closure member. The armature is movable between a first stop joined to the valve needle that limits motion of the armature in the linear stroke direction, and a second stop joined to the valve needle that limits motion of the armature opposite to the linear stroke direction. A damping spring in the form of a cup spring is positioned between the second stop and the armature.

One of the disadvantages of the fuel injector known from German Published Patent Application No. 198 49 210 is that manufacturing and assembly complexity are increased because of at least one additional component. Another is that, for example because of skewed placement of the cup spring or manufacturing tolerances that occur during production, misalignment or jamming of the armature can occur during operation of the fuel injector. Extreme variations in armature travel and in the height of the pre-stroke gap occur as a consequence. Both factors can result in malfunctions during operation of the fuel injector.

SUMMARY OF THE INVENTION

The fuel injector according to the present invention has, in contrast, the advantage that a pre-stroke of the armature is adjustable, very accurately and with no damage to the components used, by way of a clamping sleeve that can be slid onto the valve needle and positioned as desired.

It is particularly advantageous that a lateral slit in the clamping sleeve makes possible easy installation by way of an elastic preload of the tubular component, the clamping force of the clamping sleeve being selectable, by way of its axial length, to match the weight of the armature.

The particular shape of the conical bevels of the clamping sleeve advantageously ensures that non-damaging installation is possible.

It is especially advantageous that production of the entire component can be accomplished quickly and economically, since the clamping sleeve and the spacer ring are easy to manufacture and no further components are required.

DETAILED DESCRIPTION

Figure 1:
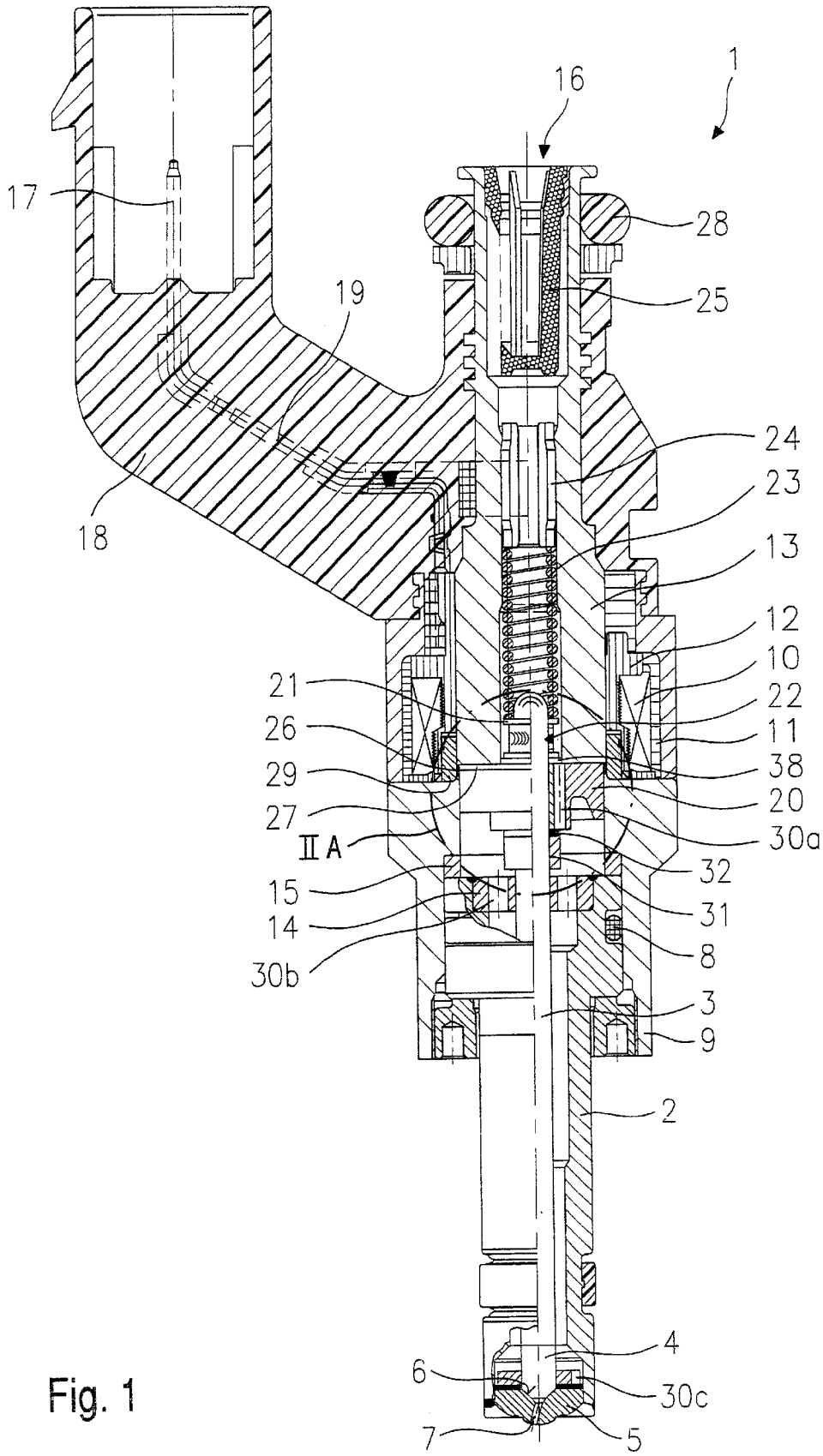
FIG. 1 is a schematic section through an exemplified embodiment of a fuel injector configured in accordance with the present invention.
Figure 2A:
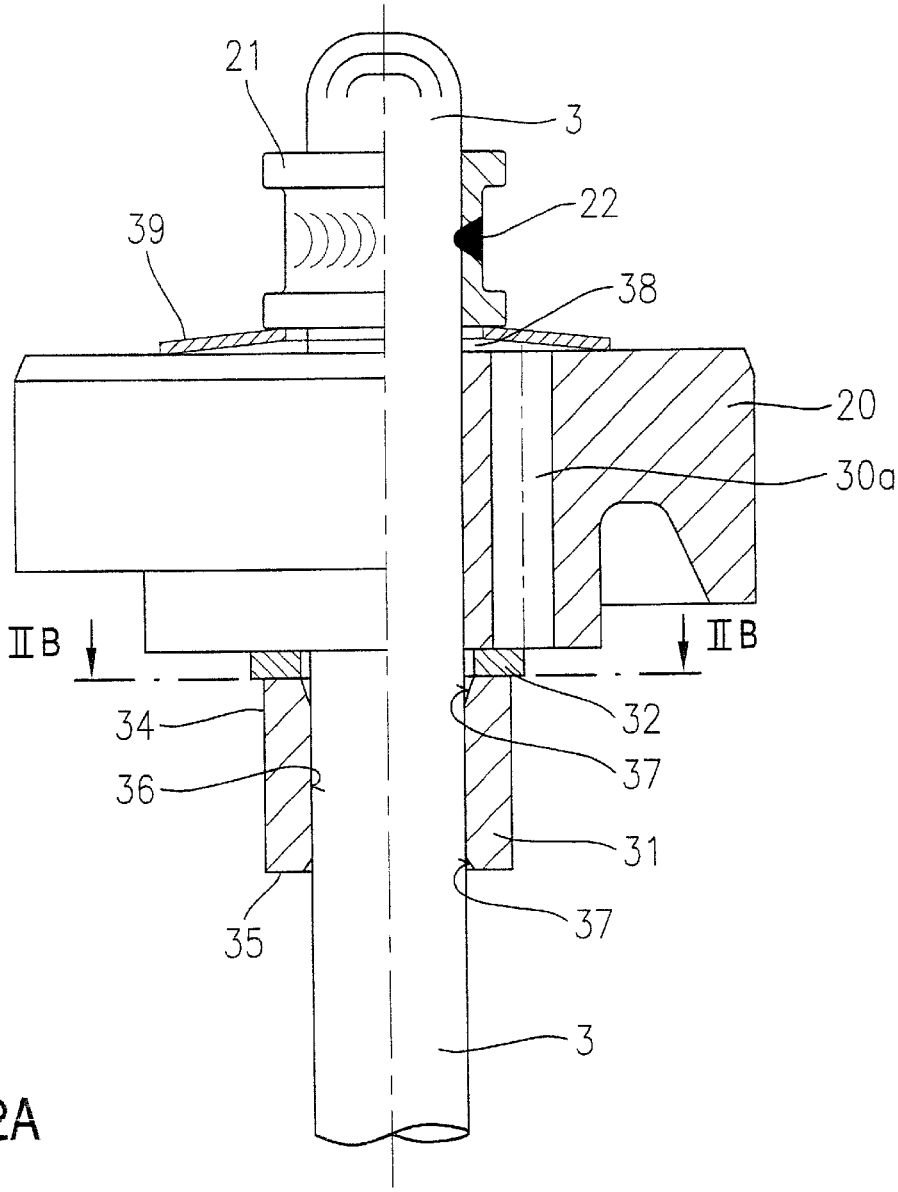
FIG. 2A schematically shows a portion, in region IIA of FIG. 1, of the fuel injector configured in accordance with the present invention.
Figure 2B:
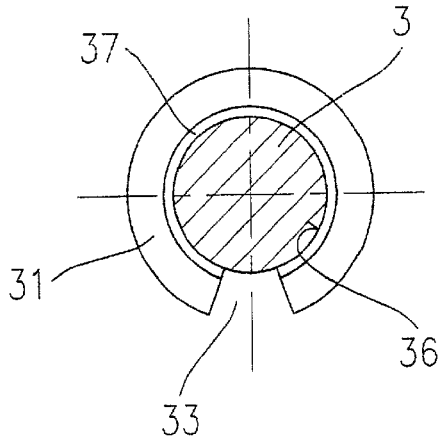
FIG. 2B is a schematic cross section, along line IIB—IIB in FIG. 2A, through the portion of the fuel injector configured in accordance with the present invention depicted in FIG. 2A.

Before a more detailed description is given of a preferred exemplified embodiment of a fuel injector 1 according to the present invention with reference to FIGS. 2A and 2B, fuel injector 1 according to the present invention will first, for better comprehension of the present invention, be explained briefly in terms of its elements with reference to FIG. 1.

Fuel injector 1 is embodied in the form of a fuel injector for fuel injection systems of mixture-compressing, spark-ignited internal combustion engines. Fuel injector 1 is suitable in particular for direct injection of fuel into a combustion chamber (not depicted) of an internal combustion engine.

Fuel injector 1 is made up of a nozzle body 2 in which a valve needle 3 is positioned. Valve needle 3 is in working engagement with a valve-closure member 4 which coacts with a valve-seat surface 6, positioned on a valve-seat member 5, to form a sealing seat. In the exemplified embodiment, fuel injector 1 is an inwardly-opening fuel injector 1 that possesses one spray discharge opening 7. Nozzle body 2 is sealed by a seal 8 with respect to external pole 9 of a magnet coil 10. Magnet coil 10 is encapsulated in a coil housing 11 and wound onto a coil support 12 that rests on an internal pole 13 of magnet coil 10. Internal pole 13 and external pole 9 are separated from one another by a gap 26, and are braced against a connecting component 29. Magnet coil 10 is energized, via a conductor 19, by an electrical current that can be conveyed via an electrical plug contact 17. Plug contact 17 is surrounded by a plastic sheath 18 that can be injection-molded onto internal pole 13.

Valve needle 3 is guided in a valve needle guide 14 of disk-shaped configuration. A paired adjusting disk 15 serves to adjust the linear stroke. Located on the other side of adjusting disk 15 is an armature 20. The latter is joined nonpositively, via an engaging flange 21, to valve needle 3, which is joined to engaging flange 21 by way of a weld seam 22. Braced against engaging flange 21 is a return spring 23 which, in the present configuration of fuel injector 1, is preloaded by a sleeve 24.

A clamping sleeve 31 that is mounted on valve needle 3 serves as the lower armature stop. A spacer ring 32, which rests on clamping sleeve 31, prevents bouncing upon closure of fuel injector 1. A detailed depiction of clamping sleeve 31 is shown in FIGS. 2A and 2B.

Fuel conduits 30*a* through 30*c*, which direct fuel, delivered via a central fuel inlet 16 and filtered through a filter element 25, to spray discharge opening 7, extend in valve needle guide 14, in armature 20, and on valve-seat member 5. Fuel injector 1 is sealed byway of a seal 28 with respect to a distribution line (not depicted in further detail).

When fuel injector 1 is in the inactive state, engaging flange 21 on valve needle 3 is impinged upon by return spring 23 opposite to its linear stroke direction in such a way that valve-closure member 4 is held in sealing contact against valve seat 6. Armature 20 rests against spacer ring 32, which is braced against clamping sleeve 31. Upon energization of magnet coil 10, the latter establishes a magnetic field that moves armature 20 in the linear stroke direction against the spring force of return spring 23. The linear stroke of armature 20 is divided into a pre-stroke that serves to close a pre-stroke gap 38, and an opening stroke that is defined by a working gap 27, present in the inactive position, between internal pole 13 and armature 20. Once the pre-stroke has been taken up, armature 20 entrains engaging flange 21 which is welded to valve needle 3, and thus valve needle 3, also in the linear stroke direction. Valve-closure member 4 that is in working engagement with valve needle 3 lifts off from valve-seat surface 6, so that the fuel, guided via fuel conduits 30*a* through 30*c* to spray discharge opening 7, is discharged.

When the coil current is shut off and once the magnetic field has decayed sufficiently, armature 20 falls onto engaging flange 21 from internal pole 13, thereby moving valve needle 3 opposite to the linear stroke direction. Valve-closure member 4 thus settles onto valve-seat surface 6, and fuel injector 1 is closed. Armature 20 settles onto clamping stop 31 and spacer ring 32.

FIG. 2A shows, in a partial sectioned depiction, the portion labeled IIA in FIG. 1 of fuel injector 1 configured in accordance with the present invention. In all the Figures, identical components are labeled with identical reference characters.

As already discussed in FIG. 1, the lower armature stop is constituted by clamping sleeve 31 and spacer ring 32 that are slid onto valve needle 3. Spacer ring 32 serves on the one hand to compensate for inaccuracies of the surface of an inflow end 34 of clamping sleeve 31, but on the other hand also as a damper to prevent armature bouncing upon closure of fuel injector 1. This is because if armature 20 bounces against inflow end 34 of clamping sleeve 31 upon closure, the reversal in the motion of armature 20 could, in the absence of damping, result in a further undesirable short-term opening stroke.

A cup spring 39 can be provided in gap 38 in order to press armature 20, in the unenergized state, against spacer ring 32.

Clamping sleeve 31 is constituted so as to make possible non-damaging installation on valve needle 3. For that purpose, clamping sleeve 31 has at its inflow end 34 and also at an outflow end 35, on a radially inner wall 36, bevels 37 or chamfers that are, for example of conical, wedge-shaped configuration and that prevent material from being chipped off upon installation of clamping sleeve 31, the consequence thereof being contamination of the interior of the valve and malfunctions of fuel injector 1 due to clogging of fuel conduits 30*b* and 30*c* or of spray discharge opening 7.

Clamping sleeve 31 is retained on valve needle 3 in such a way that it can resist the impact force resulting from the inertial mass of armature 20. The clamping force can be adapted as desired over the axial length of clamping sleeve 31 depending on the slit shape of clamping sleeve 31, since the frictional forces between valve needle 3 and inner wall 36 of clamping sleeve 31 depend on the size of the mutual contact area.

Particularly good precision adjustment is possible if clamping sleeve 31 is produced from an alloy of soft metals, for example a copper-tin alloy. One possible alloy of this kind would be, for example, $CuSn_6$.

FIG. 2B shows a section, along line IIB—IIB, through the portion of fuel injector 1 configured in accordance with the present invention that is depicted in FIG. 2A.

As already discussed above, clamping sleeve 31 has a slit 33 which on the one hand ensures that clamping sleeve 31 can be slid easily and in non-damaging fashion onto valve needle 3, and on the other hand, because of the preload that occurs, ensures reliable retention of clamping sleeve 31 in the particular position selected on valve needle 3. The position of clamping sleeve 31 and thus the height of pre-stroke gap 38 can thus be adjusted without difficulty.

The plan view of inflow end 34 of clamping sleeve 31 once again shows the bevel or chamfer 37 that, in the present exemplified embodiment, is of wedge-shaped conical configuration and extends over the entire circumference of clamping sleeve 31 outside slit 33.

The present invention is not limited to the exemplified embodiment presented and is also applicable to other forms of armature 20, for example to plunger and flat armatures, and to fuel injectors 1 of any design.

What is claimed is:

1. A fuel injector, comprising:

a magnet coil;

an armature that coacts with the magnet coil;

a valve-closure member;

a valve-seat surface;

a valve needle that is in working engagement with the armature and on which is provided the valve-closure member, the valve-closure member together with the valve-seat surface forming a sealing seat;

a first armature stop provided on the valve needle downstream from the armature; and a second armature stop provided on the valve needle, wherein:

the first armature stop includes a clamping sleeve having a slit extending in an axial direction, and an adjustable axial position of the clamping sleeve on the valve needle determines a height of a pre-stroke gap configured between the armature and the second armature stop.

2. The fuel injector as recited in claim 1, wherein:

the fuel injector is for a direct injection of a fuel into a combustion chamber of a mixture-compressing, spark-ignited internal combustion engine.

3. The fuel injector as recited in claim 1, wherein:

the clamping sleeve is slidable onto the valve needle.

4. The fuel injector as recited in claim 1, further comprising: a spacer ring positioned between the clamping sleeve and the armature.

5. The fuel injector as recited in claim 1, wherein:

the clamping sleeve includes bevels on a radially inner wall at least one of at an inflow end and at an outflow end.

6. The fuel injector as recited in claim 5, wherein:

the bevels are configured conically.

7. The fuel injector as recited in claim 1, wherein:

an axial length of the clamping sleeve is dimensioned such that a clamping force resulting from the axial length is one of greater than and equal to an impact force acting as a result of an inertial mass of the armature.

8. The fuel injector as recited in claim 1, wherein:

the clamping sleeve includes a copper-tin alloy.

9. The fuel injector as recited in claim 1, wherein:

the second armature stop is configured, upstream from the armature, as an engaging flange joined nonpositively and directly to the valve needle.

* * * * *